United States Patent [19]

Ligeti

[11] 4,158,364

[45] Jun. 19, 1979

[54] TOBACCO SMOKE FILTER

[75] Inventor: Enrique Ligeti, Pleasanton, Calif.

[73] Assignee: Albert P. Marinko, Pleasanton, Calif.; a part interest

[21] Appl. No.: 835,696

[22] Filed: Sep. 22, 1977

[51] Int. Cl.[2] ..... A24F 13/02; A24F 13/04

[52] U.S. Cl. ..... 131/187; 131/198 A; 131/210; 131/173

[58] Field of Search ..... 131/187, 198 A, 198 R, 131/210

[56] References Cited

U.S. PATENT DOCUMENTS

| | | | |
|---|---|---|---|
| 2,202,288 | 5/1940 | Heron | 131/198 R |
| 2,951,486 | 9/1960 | Walters | 131/198 R |
| 3,810,476 | 5/1974 | Thomas | 131/187 |
| 3,926,199 | 12/1975 | Thomas | 131/187 |

*Primary Examiner*—Stephen C. Pellegrino

[57] ABSTRACT

A tobacco smoke filter embodied in a holder for retaining cigarettes and cigars during the smoking thereof wherein inhaled smoke is drawn by suction through a series of sections and successively expanded and contracted to remove more and more tar and nicotine therefrom with means for cooling the smoke during its passage through the sections.

5 Claims, 11 Drawing Figures

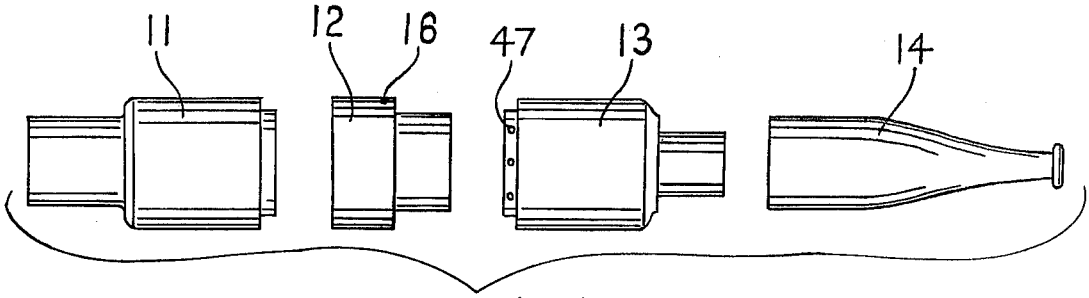
FIG. 5
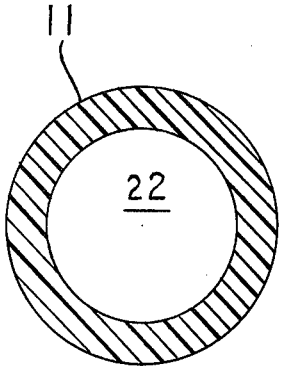
FIG. 6
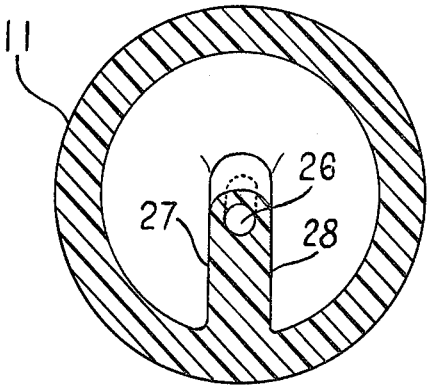
FIG. 7
FIG. 8
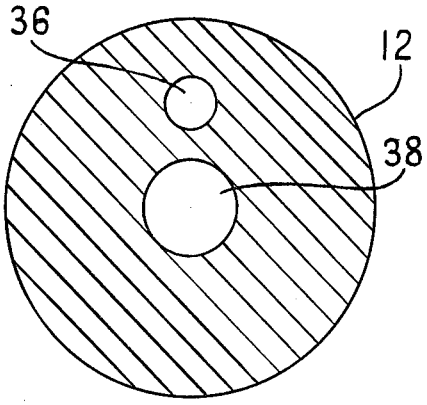
FIG. 9
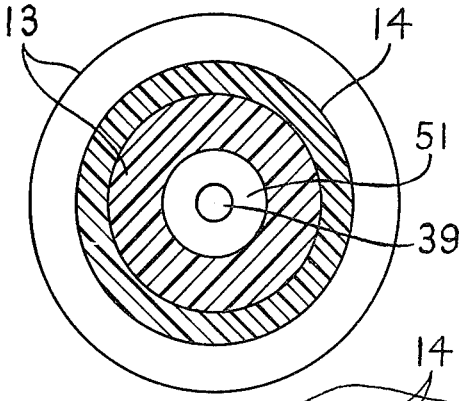
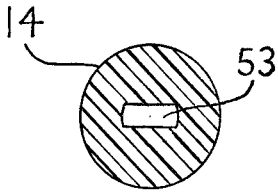
FIG. 10
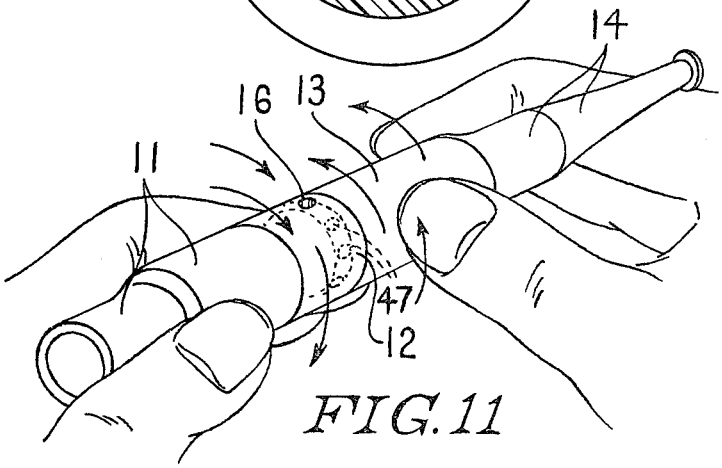
FIG. 11

TOBACCO SMOKE FILTER

During recent years an increasing number of different types of smoke filtering devices have been developed. Many of these devices have been made the subject of U.S. Letters Patent among them being U.S. Pat. No. 3,367,345 showing a cigarette holder featuring a radially extending constricted bore for accelerating the velocity of the smoke as it is pulled from a lighted cigarette on inhalation. Prior patents in this field or environment also are U.S. Pat. No. 3,174,487 covering another construction for removing tars and nicotine from traveling smoke which includes an insertable baffle unit having a grooved hemispherical portion thus affording a definite directional path for the smoke to take as it is drawn; U.S. Pat. No. 3,434,480 covering a disposable filter in which a plurality of baffle inserts are provided having transverse and peripheral slots therein; U.S. Pat. No. 3,468,316 covering a filter which is of complex and expensive construction including specially formed surfaces of a plug 12 in relation to the wall of sleeve 10, as embodied in cylindrical disc portions 36, 37, and 38 wherein the transverse cross-sectional areas thereof are equal to the cross-sectional area of bore 14, see FIG. 3; together with U.S. Pat. No. 3,685,522 disclosing a cigarette holder for variably diluting the drawn smoke with atmospheric air controlled by a built-in valve. Other patents in this general field are U.S. Pat. Nos. 3,690,329; 3,810,476, and 3,926,199. My present invention actually removes tars and nicotine on successive inhalations by alternation of expanding and contracting the smoke coupled with means for dissipating developed heat, as well as provides a relatively simple and inexpensive assembly which obviates all of the disadvantages of prior tobacco smoke filters.

A primary object of my present invention is to provide an improved tobacco smoke filter which is highly efficaceous in condensating nicotine and tar from the smoke.

Another important object of the invention is to provide a tobacco smoke filter of the indicated nature which is additionally characterized by the inclusion therein of a heat dissipating element permitting only a small amount of smoke to pass therethrough in a given time.

A still further object of my invention is to provide an improved tobacco smoke filter of the aforementioned character which enables the cooling of the smoke as desired.

Other objects of the invention, together with some of the advantageous features thereof, will appear from the following description of a preferred embodiment and certain modified embodiments of the invention which are illustrated in the accompanying drawings exemplifying the best mode of construction and manner of using the same.

Referring to the drawings:

FIG. 5 is an exploded view of the assembly of FIG. 1, illustrating the detachable sections thereof in the order of their interconnections to one another.

FIG. 6 is an enlarged sectional elevational view taken on the line 6—6 of FIG. 3.

FIG. 7 is an enlarged sectional elevational view taken on line 7—7 of FIG. 3 and showing the expanded and constricted relationship of the smoke passage or bore within a single section of the assembly.

FIG. 8 is an enlarged sectional elevational view taken on the line 8—8 of FIG. 3 showing the construction of the heat dissipator section.

FIG. 9 is an enlarged sectional elevational view taken on the line 9—9 of FIG. 3 and illustrating the expanded and restricted bore extending through the series of dove-tailed fitting sections of the assembly.

FIG. 10 is an enlarged elevational section taken on line 10—10 of FIG. 3 illustrating the restricted bore at the mouthpiece section of the filter.

FIG. 11 is a perspective view of the assembly with arrows to show relative movement of certain sections for adjusting the path of movement of inhaled smoke.

In its preferred and best mode of construction, the tobacco smoke filter of the present invention comprises an assembly of a plurality of detachably connected sections including a cigarette or cigar receiving and holding section, a heat dissipating section, an adjustment section for increasing and decreasing the restricted travel of the inhaled smoke, and a mouth-piece section; said sections together defining restricted areas and expansion chambers for condensating the inhaled smoke to remove more and more nicotine and tars from the inhaled moving smoke.

Figure 1:
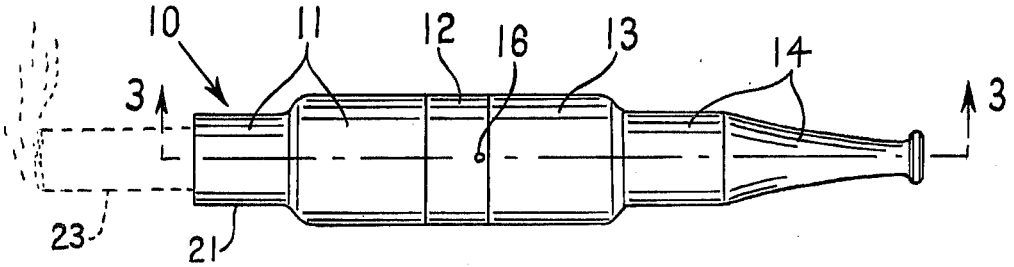
FIG. 1 is a front elevational view of a preferred embodiment of the invention.

In accordance with my invention, I provide in an assembly which is embodied in a cigarette of cigar holder that is designated generally by the reference numeral 10, a plurality of specially formed filter sections which are designate generally by the reference numerals 11, 12, 13 and 14 and which are illustrated in FIG. 1 of the annexed drawings in assembled form as a preferred embodiment of the invention; such sections being also illustrated in exploded or disassembled form separately or individually in FIG. 5. The sections may be fabricated or molded from any desired material. In the present embodiment, I fashion sections 11, 13 and 14 from an acrylic plastic material but any other suitable plastic may be employed, such as a urea or a phenol condensate, which is extruded into a suitable mold for each of these plastic sections. Section 12 is fabricated from a heat-dissipating metal, such as aluminum or an aluminum alloy; and can be made in connectable two parts or can be cast as in integral unit for sake of economy.

Figure 2:
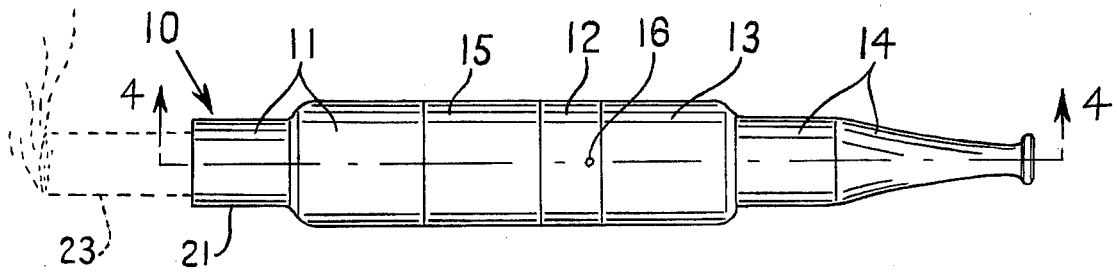
FIG. 2 is a front elevational view of a modified embodiment of the invention.

As particularly illustrated in FIG. 2 of the accompanying drawings, a modified embodiment of the present invention comprises a specially constructed section 15 which is conveniently interposed between sections 11 and 12 and which perfrms in about the same manner as section 11 thereby further lessening the intake by the smoker of nicotine and tar.

Figure 3:
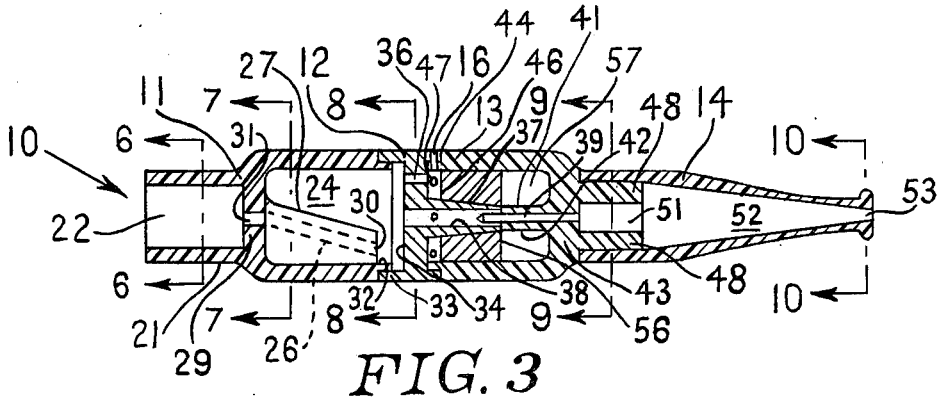
FIG. 3 is a longitudinal sectional elevational view of the preferred embodiment of FIG. 1 and taken on the line 3—3 thereof.

In FIG. 3 of the accompanying drawings, I have shown, in sectional elevation, details of the form of construction of each of the several sections 11 to 14 inclusive which define the path of travel of successive inhalations of tobacco smoke from a lighted cigarette or cigar; it being immediately observable that such form of construction effects successive alternations of restricted travel areas and expansion chambers thereby effecting rapid condensation of the smoke and effective removal of more and more nicotine and tars. In order to enable the admission of air into the inhaled smoke when desired, I provide a small opening 16 in section 12 which can be placed in communication with the interior of the older 10 as hereinafter described.

Each of the various connectable and detachable sections of my improvement is specially constructed in order to attain optimum and efficaceous results not only in effecting the reduction of nicotine and tar intake upon the successive inhalations of tobacco smoke but also in affording a cooler and more delightful experience on every occasion of smoking a cigarette or cigar. To this end and as illustrated all of the sections are formed to a smooth outer periphery for ease in handling the detachably connected sections as well as for aesthetic purposes. Specially constructed section 11 is formed with a reduced laterally extending hollow element 21 defining an inlet chamber 22 into which a cigarette 23, shown in dotted outline, can be inserted and held while being smoked; such element 21 being integral with and merging with a generally u-shaped longitudinally extending portion defining an enlarged chamber 24 and providing an inclined restrictive bore 26 defined by a pair of opposed or confronting inclined flanges 27 and 28 extending inwardly from the transverse base 29 of the u-shaped portion of section 11 with a restricted outlet 30; said base 29 having a passage 31 therein communicating with the inlet chamber 22 as well as with the bore 26.

It will thus be observed that by this construction, I have provided for a relative large inlet chamber 22 for accommodating a cigarette which is in direct communication with a restricted passage 31 directly communicating with the slanting restricted bore 26 having its outlet 30 in close proximity to an inner wall of section 11 and opening to the expanded chamber 24 thereof. The inhaled tobacco smoke travels through expansion chamber 22 and is immediately compressed through the restricted passage 31 and through restricted bore 26 and again expanded into large chamber 24. During this travel and consequent compression and expansion of the tobacco smoke a relatively high percentage of the nicotine and tars are removed from the smoke. The special construction of section 11 includes the provision of an annular inner shoulder 32 for removably receiving a laterally projecting annular flange 33 formed on section 12 of the holder 10, which is preferably fabricated from a heat-dissipating metal such as aluminum or an aluminum alloy, and which includes a transverse web 34 formed with a restricted passage 36 therethrough adjacent to one side of the holder.

By virtue of this special construction of section 12, additional nicotine and tar are trapped from the traveling smoke as it is compressed from the enlarged or expanded chamber 24 of section 11 into and through the restricted passage 36 of the web of section 12. The web 34 carries a part 37, either as an integral casting therewith or as a separate element connected thereto by riveting which consists of a hollow tapering unit having a tapering restricted bore 38 to guide the tobacco smoke into an axially extending bore 39 fashioned in section 13 of holder 10 by inturned confronting flanges 41 and 42 which are projected rearwardly and in parallel relationship from the base 43 of the generally u-shaped section 13. To make the detachable connection between sections 12 and 13, I provide an annular outer flange 44 on section 12 which rotatably seats on an annular inner shoulder 46 of section 13. It is to be especially observed that I preferably fashion inner shoulder 46 with a series of radial passages 47 which are circumferentially spaced apart and which establish communication with the exterior of the holder through opening 16 of the holder and which extends through flange 44 of section 12. Air can thus be drawn through opening 16 into the radial passages 47 of inner annular shoulder 46 to pass the air into the tobacco smoke traveling through the bore 38 of tapered unit 37 and thence into and through the axial bore 39. The restricted bore 39 opens into a slightly expanded chamber 51 defined by the reduced portion 48 at the outer end of section 13 and serving as a mount for the mouth-pice section 14 of the holder which, in turn, defines a long tapering chamber 52 merging with the slightly expanded chamber 51 at the inner end thereof and merging into the restricted outlet 53 of the holder through which the inhaled smoke enters the mouth of the smoker. It is to be noted, also, that the special construction of plastic section 13 includes a relatively wide inner annulas in meeting engagement with the inner wall 56 of such section for guiding a portion of the traveling tobacco smoke into an expanded chamber 57 from which it also enters the restricted bores 38 and 39 thus further trapping additional amounts of nicotine and tars by the compression of the smoke.

By virtue of the dove-tail connection between the annular outer flange 44 of section 12 and the perforated annular inner shoulder 46 of section 13, it is relatively easy to pull sections 12 and 13 apart, and in the event it is desired to cool the smoke, a few drops of water can be introduced into section 13 after disconnecting the same from section 12.

Figure 4:
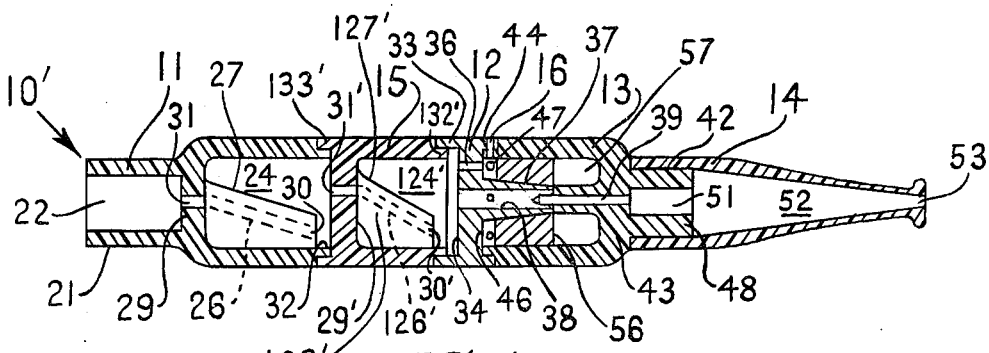
FIG. 4 is a longitudinal sectional elevational view of the modified embodiment of FIG. 2 and taken on the line 4—4 thereof.

Should the smoker desire to reduce further amounts of nicotine and tar from the cigarette smoke, he can employ the modified holder 10' illustrated in FIGS. 2 and 4 of the annexed drawings. This modification is similar to a large extent with the preferred embodiment but differs therefrom by the inclusion of section 15 which is interposed between sections 11 and 12. As shown section 15 is so constructed as to provide a generally u-shaped element extending longitudinally from a transverse base 29' having a through opening 31' adjacent to one wall; such opening communicating with expanded chamber 24 of section 11 at one end thereof and with a slanting bore 126' at the outer end thereof. The bore 126' is defined by a pair of inturned slanting flanges 127' and 128' and terminates adjacent one horizontally extending wall of the section in an outlet 130'; said flanges 127' and 128' defining an expanded chamber 124' of section 15 which merges into the constricted passage 36 of section 12. Section 15 is fashioned at one end thereof with an annular flange 133' for removably mounting of the section on the annular inner shoulder 32 of section 11, and at the outer end thereof with an annular inner shoulder 132' for rotationally receiving the adjacent annular flange 33 of section 12 of the holder 10'.

With reference to FIG. 11, it will be observed that section 13 can be rotated, as indicated by the small arrows, relative to section 12 to bring the vent or opening 16 into registry with any selected one of the radial passages 47 in the annular perforated inner flange 46 on section 13. Thus, the amount of air admitted into the interior of the chambers and bores of sections 13 and 14 can be varied and controlled so as to maintain the same cool during the smoking of the cigarette or cigar.

It is to be understood that the appended claims are intended to cover not only the embodiments illustrated but also variations thereof within the scope and purview of the invention.

I claim:

1. A tobacco smoke filter comprising an assembly of a plurality of detachably connected sections; said assembly consisting of a first section for holding a burning cigarette and for passing inhaled tobacco smoke, said first section comprising a u-shaped structure having a pair of inturned slanting flanges arranged in confronting relationship to define an inclined restricted bore through which inhaled tobacco smoke is drawn from a restricted opening leading from an expanded smoke inlet to said restricted bore which terminates adjacent a side wall of said first section to open into a second expanded chamber of said first section, a second section removably attached to said first section; said second section comprising two parts of which one part consists of a transverse web having a restricted passageway therethrough adjacent to one side thereof and communicating at its one end with said second expanded chamber of said first section, and the other part of section two consists of a connected tapering element having a tapering bore therethrough for conducting the inhaled smoke, said second section having an annular flange thereon, having an opening therein leading to the exterior thereof to admit air into the interior thereof, a third section detachably and rotatably connected to said second section; said third section having an annular inner shoulder having a series of spaced apart radially extending passages of different cross-sections therein which are adapted to be selectively placed in communication with said opening of said annular flange of said second section to conduct air from the exterior to the tapering bore of said tapering element of said second section; said third section having an expanded compartment for gathering inhaled smoke led through said second section, a reduced hollow member on the outer end of said third section having its defined slightly expanded bore communicating with said tapering bore of said tapering element of said second section, and a mouth-piece section telescopically fitted to said reduced hollow member of said third section.

2. A tobacco smoke filter as set forth in claim 1, and laterally extending annular flanges on said section for removably fitting annular shoulder on said first section and said third section of said assembly.

3. A tobacco smoke filter as set forth in claim 1 wherein said expansion chambers of said first section are on both sides of said restricted passageway.

4. A tobacco smoke filter as set forth in claim 1, wherein said slanting restricted bore lies intermediate said expanded chambers of said first section.

5. A tobacco smoke filter as set forth in claim 1 wherein compression of the smoke and consequent removal of nicotine and tars occurs upon movement of inhaled smoke between constricted passages and expanded chambers.

* * * * *